United States Patent [19]

Blume et al.

[11] 4,052,294

[45] Oct. 4, 1977

[54] METHOD OF SOLVENT RECOVERY IN AUTOREFRIGERANT/KETONE DEWAXING PROCESSES

[75] Inventors: John H. Blume, Chester; James D. Bushnell, Berkeley Heights, both of N.J.

[73] Assignee: Exxon Research & Engineering Co., Linden, N.J.

[21] Appl. No.: 627,711

[22] Filed: Oct. 31, 1975

[51] Int. Cl.[2] ..... C10G 43/08

[52] U.S. Cl. ..... 208/33; 208/35

[58] Field of Search ..... 208/35, 321, 33

[56] References Cited

U.S. PATENT DOCUMENTS

| | | | |
|---|---|---|---|
| 2,202,542 | 5/1940 | Voorhees | 208/35 |
| 2,886,610 | 5/1959 | Georgian | 208/321 |
| 2,907,709 | 10/1959 | Benedict | 208/321 |
| 3,470,088 | 9/1969 | Vickers | 208/321 |
| 3,622,496 | 11/1971 | Biribauer et al. | 208/35 |

*Primary Examiner*—Herbert Levine

*Attorney, Agent, or Firm*—Edward M. Corcoran

[57] ABSTRACT

Autorefrigerative and ketone solvents are separated and recovered from dewaxed oil and wax through the use of high and low pressure flashes followed by steam stripping. Water buildup in the recovered solvent is prevented by the use of a decanter and deketonizer wherein the overheads from the strippers are sent directly to the deketonizer and the overhead therefrom sent to the decanter, thereby substantially reducing the size of the deketonizer required. Water is removed from the recovered solvent in the deketonizer and may be sent to sewerage.

12 Claims, 1 Drawing Figure

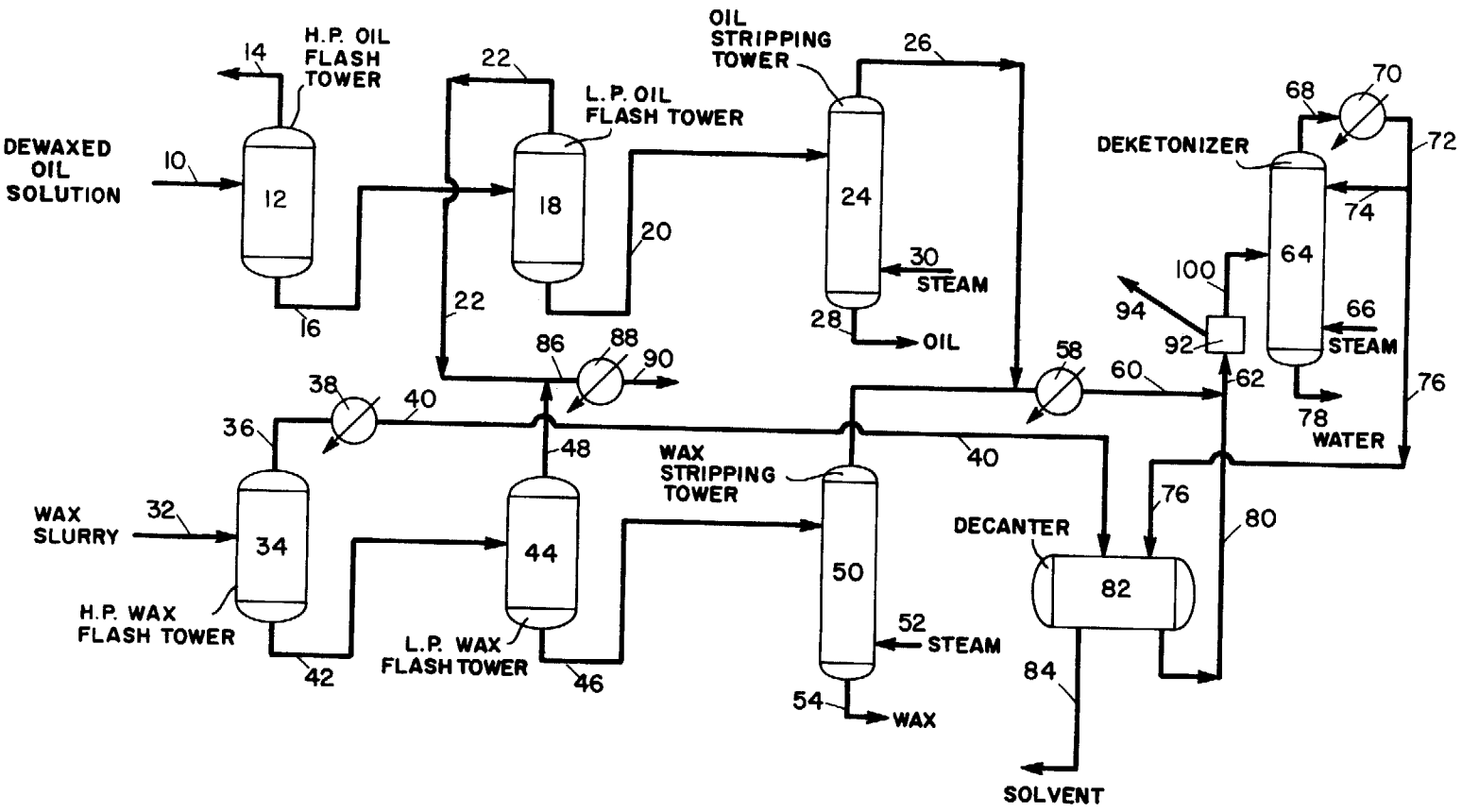
DEWAXED OIL SOLUTION
H.P. OIL FLASH TOWER
L.P. OIL FLASH TOWER
OIL STRIPPING TOWER
STEAM
OIL
DEKETONIZER
STEAM
WATER
WAX SLURRY
H.P. WAX FLASH TOWER
L.P. WAX FLASH TOWER
WAX STRIPPING TOWER
STEAM
WAX
DECANTER
SOLVENT

METHOD OF SOLVENT RECOVERY IN AUTOREFRIGERANT/KETONE DEWAXING PROCESSES

BACKGROUND OF THE INVENTION

1. Field of the Invention

This invention relates to a method for recovering autorefrigerative and ketone solvents while preventing water buildup in the recovered solvent in a solvent dewaxing process. More particularly, this invention prevents water buildup in a process for recovering autorefrigerative/ketone dewaxing solvents by passing same to a decanter and deketonizer, the excess water being removed therefrom in the deketonizer. Still more particularly, this invention relates to an improved process for preventing water from building up in the recovered solvents of an autorefrigerative/ketone solvent dewaxing process which employs steam stripping to remove at least a portion of the solvents from the wax or dewaxed oil, by passing the wet overheads from the stripping step to a decanter and deketonizer, excess water being removed from the wet solvent in the deketonizer.

2. Description of the Prior Art

It is well known in the art to remove waxy constituents from wax-containing hydrocarbons, particularly from wax-containing petroleum oils such as lube oil stocks, by various methods. Generally these processes comprise mixing the waxy oil with a solvent and chilling the resultant mixture to a temperature at which the wax crystallizes out of solution. The amount of wax removed from the oil depends on the type of oil to be dewaxed, the amount and composition of solvent used, the temperature at which the separation of dewaxed oil from precipitated wax takes place, etc.

A multitude of so-called dewaxing processes have been developed and are well known in the art. These include both batch and continuous dewaxing processes. Many processes have also been developed around the application of a particular type of dewaxing solvent. Two types of solvent dewaxing processes have gained particularly widespread use in the art. These are known as the ketone dewaxing process and the autorefrigerative (propane, propylene, etc.) dewaxing process. More recently, a process employing a dual-solvent system comprising a mixture of an autorefrigerant with a wax antisolvent such as a ketone has been developed and commercially tested.

Solvents employed in ketone dewaxing processes are generally ketones containing from three to six carbon atmos such as acetone, methyl ethyl ketone, methyl isobutyl ketone, etc. or mixtures thereof and they may also be used in combination with aromatics solvents such as benzene, toluene, petroleum naphtha or mixtures thereof. Chilling is accomplished either indirectly in scraped surface heat exchangers after the solvent has been thoroughly mixed with the waxy oil, or, mixing and chilling are accomplished simultaneously by incrementally injecting the cold dewaxing solvent into the waxy oil along a plurality of points or stages along a cooling tower as the waxy oil passes through same, which is known in the art as DILCHILL crystallization, or, DILCHILL crystallization followed by additional cooling in scraped surface heat exchangers. A major disadvantage in all of the ketone dewaxing processes is the need for heat exchangers to cool the dewaxing solvent, the scraped surface devices, etc.

Autorefrigerative dewaxing processes employ a low molecular weight autorefrigerant hydrocarbon, such as propane, which is a gas at standard temperatures and pressures. The autorefrigerant is added to the warm, waxy oil as a liquid under pressure. It is then allowed to evaporate, thereby autorefrigerating the mixture in situ. The disadvantage of this process as compared with the ketone processes is that the relatively high solubility of wax in the autorefrigerant at any given temperature does not permit the removal of as much wax as, or of producing dewaxed oil with pour points as low as, is achieved with the ketone dewaxing processes at the same filtration temperature. This requires that the oil be chilled to substantially lower temperatures when employing autorefrigerative solvents for in situ chilling than in ketone dewaxing processes, in order to achieve a specified wax content or pour point.

A great improvement in dewaxing processes has been realized in recent years by the use of an autorefrigerant/ketone dual-solvent system. Basically, this dual-solvent process employs a highly volatile autorefrigerant such as propane or especially propylene, in admixture with a ketone wax antisolvent, such as acetone or methyl ethyl ketone, in order to reduce the solubility of the wax in the autorefrigerant. One such process is taught in U.S. Pat. No. 3,503,870, the disclosures of which are incorporated herein by reference. This dual-solvent system combines most of the advantages of both the autorefrigerant and the ketone dewaxing processes. Low pour point oils can be obtained with only a small difference between the wax filtration temperature and the pour point of the dewaxed oil. At the same time, autorefrigeration is used for in situ cooling thereby eliminating or reducing the necessity of scraped surface heat exchangers. Although the dual-solvent system has many advantages, one of its major disadvantages has been the lack of an efficient solvent recovery process that prevents water buildup in the solvent system.

Solvent recovery systems for dual-solvent dewaxing processes have been directed towards recovering the autorefrigerative and ketone solvents from the dewaxed oil and wax through the use of high and low pressure flash evaporation followed by gas stripping, as outlined in U.S. Pat. No. 3,622,496, the disclosures of which are incorporated herein by reference. U.S. Pat. No. 3,622,496 is directed toward the use of autorefrigerant vapors for stripping the remaining solvent from the dewaxed oil and wax after most of it has been recovered by a combination of high and low pressure flash evaporation. This system, using gases such as propane or propylene, attempts to alleviate the water problem by recycling dry gas instead of employing once through steam for final removal solvent. However, there are two disadvantages to this system. The first is that some water always enters the process dissolved in the feed with a resultant water buildup in the solvent. The second disadvantage is that some propylene dissolves in the liquid leaving the low pressure flash towers resulting in loss of solvent and also requiring explosivity corrections to the dewaxed oil and wax products to remove the last traces of dissolved propane or propylene.

It would be a significant improvement to the art if steam stripping could be efficiently and economically employed to remove the last traces of solvent from both the dewaxed oil and wax without causing water buildup in the solvent system. If too much water is allowed to build up in the solvent system of a dual-solvent dewaxing process, ice crystals form on the wax cake in the wax filters clogging same, thereby upsetting the filtration operation. More importantly, when a portion of the solvent is cooled to filtration temperature for use as wash and reslurry solvent, ice crystals tend to plug up the heat exchangers in which it is cooled, as well as the control valves and small passages in the headers which distribute it over the filter drums in the wax filters.

SUMMARY OF THE INVENTION

It has now been found that steam can be efficiently and economically employed as the stripping gas in a dual-solvent autorefrigerant/ketone solvent recovery system employing high and low pressure flash evaporation followed by gas stripping, while at the same time preventing water buildup in the recovered solvent by passing the stripper overheads to decanting and deketonizing steps which together act as dehydration means, with excess water being removed from the recovered solvents in the deketonizing operation. The instant invention therefore is an improvement to the solvent recovery system of a dual-solvent dewaxing process, which process comprises contacting a waxy lube oil stock with a dewaxing solvent comprising a mixture of a ketone wax antisolvent and an autorefrigerant to produce a dewaxed oil and wax slurry containing said solvents and wherein at least a portion of said solvents are recovered therefrom by a method which introduces excess water into said recovered solvents, the improvement comprising removing the excess water from the recovered solvents by passing at least a portion thereof to a deketonizing zone to produce substantially ketone-free water and wet ketone, with at least a portion of said wet ketone being passed directly therefrom to a decanting zone wherein a liquid layer of said autorefrigerant is maintained which contains said ketone and minor amounts of water and a liquid layer of wet ketone and wherein at least a portion of said wet ketone layer is continuously recycled bck to said deketonizer for the removal of excess water therefrom and wherein at least a portion of said autorefrigerant is continuously removed from the decanting zone.

More particularly, the instant invention is an improvement to the solvent recovery system of a dual-solvent dewaxing process, which process comprises contacting a waxy lube oil stock with a dewaxing solvent comprising a mixture of autorefrigerative and ketone solvents, cooling the oil/solvent mixture to crystallize wax from the oil thereby forming a dewaxed oil and wax, separating the wax from the dewaxed oil, and recovering the solvent from the wax and dewaxed oil through the use of high and low presure flash evaporation followed by gas stripping, the improvement comprising using steam as the stripping gas and preventing water buildup in the recovered solvent by passing the wet solvent overheads from the steam stripping to decanting and deketonizing zones and simultaneously passing solvent overheads from the wax high pressure flash evaporator to the decanting zone. Further, it has unexpectedly been found that if the wet overheads from the steam stripping are first passed to the deketonizing zone, as opposed to the decanting zone, the size of the equipment required in the deketonizing zone may be substantially reduced.

The term "flash evaporation" as used herein is not necessarily limited to only a flash evaporation step or tower, but may also include rectification. That is, both the high and low pressure flash steps may occur in flash towers containing a rectification zone with reflux. Also, by high pressure is meant a pressure equal to or exceeding 100 psig, while low pressure refers to less than 100 psig.

The decanting zone or step is essential to the practice of the instant invention and may take place in a settling or decanting drum. In the decanting drum two immiscible liquid layers coexist in equilibrium: an autorefrigerant-rich liquid layer containing less than 1 wt.% water and an aqueous liquid ketone phase. In addition, an autorefrigerant vapor phase also exists in the drum bove the autorefrigerant-rich liquid layer. Because water is insoluble in the autorefrigerant, the autorefrigerant layer is able to extract some of the ketone from the aqueous ketone phase (from the steam strippers) with the ketone enriched autorefrigerant low enough in water content to be recycled back to the dewaxing operation. At the same time, the aqueous ketone phase or layer is continuously recycled to the deketonizer wherein at least a portion of the water is removed therefrom, with the overhead from the deketonizer, comprising an aqueous ketone phase but with a water content somewhat less than that of the aqueous ketone phase in the decanter, continuously recycled back to the decanter. Therefore, in the decanting step the autorefrigerant serves to continuously remove ketone from the aqueous ketone phase, with the ketone enriched autorefrigerant recycled back into the dewaxing operation.

It will be immediately obvious to those skilled in the art that proper control of process parameters such as temperature, pressure and solvent composition are critical to the successful implementation of this step. Also, the decanting step may be accomplished in a single, simple piece of equipment such as a single drum, internally baffled to divide the inside thereof into a mixing zone and a settling zone. Alternatively, more than one piece of equipment may be employed to provide the mixing and settling zones. Finally, in a preferred embodiment of the instant invention the autorefrigerant is supplied to the decanting step from the wax high pressure flash tower since this stream will contain the water initially introduced with the feed as well as any water that is in the recycled solvent stream from the decanter.

The deketonizing step serves to remove water from the aqueous ketone solvent recovered from the steam strippers. The steam stripper overheads may be fed directly to the deketonizer or may be fed to the decanter. In the latter case, the stripper overheads mix with the aqueous ketone phase in the decanter which is continuously withdraw from the decanter and fed to the deketonizer. The deketonizing may take place in an atmospheric or vacuum distillation tower, flash evaporator, steam or other gas stripper, etc. A preferred embodiment comprises a simple packed column steam stripper. The deketonizer overheads comprise an aqueous ketone phase, at least a portion of which is recycled back to the decanter, another portion of which may be returned to the tower as reflux. The water removed from the aqueous ketone will contain less than 50 wppm (weight parts per million) ketone and may be sent directly to sewerage.

Prior to the process of the instant invention, the use of acetone in dewaxing operations required elaborate, complex and costly water removal schemes, due to the fact that water and acetone (a) are miscible in all proportions and (b) form an azeotrope so that water cannot be removed therefrom by distillation.

The most preferred solvent is a mixture of propylene and acetone. A particularly preferred solvent is an 80/20 LV% (liquid volume) mixture of propylene and acetone.

BRIEF DESCRIPTION OF THE DRAWINGS

The attached drawing is a flow diagram of a preferred embodiment of a dewaxing process employing the improvement of the instant invention.

DETAILED DESCRIPTION

Referring to the drawing, dewaxed oil solution from wax filters (not shown) is fed into high pressure flash evaporation tower 12 via line 10 to remove most of the autorefrigerant from the oil. The autorefrigerant is removed from tower 12 via line 14 and recycled back to the dewaxing operation or sent to solvent storage. The dewaxed oil from tower 12 is removed via line 16, passed to low pressure flash tower 18, wherein most of the ketone solvent is removed, and then fed to stripper 24 via line 20. Dewaxed oil low pressure flash evaporation tower 18 serves to remove most of the ketone solvent from the oil as overhead vapors via line 22 where it is combined with the ketone overhead vapors from the wax low pressure flash tower 44 and passed to heat exchanger 88 via line 86 which cools and condenses the ketone to the liquid state. The condensed ketone may then be recycled back to the dewaxing operation or sent to solvent storage. A portion of the condensed ketone may be periodically heated and sent to hot wash the filter drum, via line 90, to clean the pores of the filter cloth on the filter drums. The dewaxed oil is passed from tower 18 to stripper 24 via line 20 wherein the remaining or residual solvent is removed from the oil by contacting same with steam which enters stripper 24 via line 30. Substantial solvent-free dewaxed oil is removed from stripper 24 as bottoms via line 28, while the solvent is removed as wet overhead via line 26. Concurrently with the passage of the dewaxed oil solution through the high and low pressure flash towers and steam stripper, wax slurry from the filters also passes through high and low pressure flash evaporation towers and steam stripper to separate the solvent from the wax. The wax slurry from the filters is fed to high pressure flash tower 34 via line 32 to remove most of the autorefrigerant, then via line 42 to low pressure flash tower 44 wherein most of the ketone is removed and finally to steam stripper 50 via line 46. Steam entering stripper 50 via line 52 contacts the wax therein thereby removing the solvent remaining in the wax after the high and low pressure flashes. Slack wax is removed from stripper 50 via line 54. The ketone overhead from the low pressure wax flash tower 44 is removed via line 48 and combined with the overhead from the dewaxed oil low pressure flash tower 18 for hot washing the wax filters, etc. The overhead from wax high presure flash tower 34, comprising mostly autorefrigerant, is passed through line 36 to condenser 38 wherein it is cooled to the liquid phase and then to decanter 82 via line 40. Wet overhead from wax stripper 50 is passed to heat exchanger 58 wherein it is cooled and combined with the wet overhead from oil stripper 24, the cooled, combined overheads then being fed to a steam stripper or deketonizer 64 via lines 60, 62 and 100. Alternatively, the combined wet stripper overheads may first be fed into decanter 82 and then to deketonizer 64 as part of the aqueous phase going to deketonizer 64 from decanter 82 via lines 80, 62 and 100. Expansion drum 92 merely serves to remove autorefrigerant, via line 94, from the ketone/water stream being fed to deketonizer 64. Small amounts of autorefrigerant are present in the combined stripper overheads as well as in the decanter/deketonizer recycle. The expansion drum is needed in the decanter/deketonizer recycle only if the stripper overheads are first passed to deketonizer 64 and then to decanter 82.

Deketonizer 64 and decanter 82 act together to prevent water buildup in the solvent system by continuously removing same from the recovered solvent. The water so removed is relatively free enough of solvent to be passed directly to a sewer from deketonizer 64 via line 78. Two liquid phases coexist in equilibrium in decanter 82; an autorefrigerant phase and an aqueous ketone phase. The autorefrigerant phase has a low enough water content to be recycled directly back to the dewaxing operation via line 84 without having to undergo any additional water removal treatments, while the aqueous phase is continuously withdrawn from decanter 82 via line 80 where it is returned to deketonizer 64 through lines 62, drum 92 and line 100. Steam enters deketonizer 64 via line 66 and contacts both the combined, condensed wet stripper overheads and the aqueous decanter recycle. Relatively solvent-free water is removed from deketonizer 64 via line 78 and sent to sewerage. At least a portion of the deketonizer overhead is removed via line 68, passes through heat exchanger 70 wherein it is cooled and condensed to the liquid state and is then fed to decanter 82 via lines 72 and 76. Some of the condensed deketonizer overhead may be recycled back to the deketonizer as reflux via line 74.

The petroleum fractions employed in this process will have an initial boiling range of from between 400° F to 1500° F, with an initial wax content of at least 1.0 wt.%. The preferred oil stocks are lubricating oil and specialty oil fractions, boiling within the range of from 550° F to 1300° F. Deasphalted resids and bright stocks may also be used. These petroleum oil fractions may come from any source, such as the paraffinic crudes obtained from Aramco, Kuwait, Panhandle, Western Canada, etc., or the heavier fractions of naphthenic crudes such as U.S. Coastal crudes, Venezuelan, Tia Juana and those derived from Athabasca Tar Sands, etc.

The autorefrigerant/ketone dual-solvent system comprises a mixture of a ketone selected from the group consisting of $C_3$ to $C_6$ carbon atom ketones such as acetone, methyl ethyl ketone (MEK) and methyl isobutyl ketone (MIBK), along with an autorefrigerant selected from the group consisting of normally gaseous $C_2$ to $C_4$ hydrocarbons, such as propane, propylene, ethane, ethylene, butanes, butylenes and mixtures thereof. The most preferred solvent is a mixture of acetone and propylene. A particularly preferred solvent comprises an 80/20 LV% (liquid volume) mixture of propylene/acetone during the wax filtration step.

High pressure flash evaporation towers 12 and 34 operate at a temperature and pressure of from about 200° F to 500° F and 100 psig to 300 psig, preferably at 250° F to 450° F and 200 psig to 250 psig. The temperature in low pressure flash towers 18 and 44 is dependent on the temperature of the entering oil and wax streams which, in turn is dependent on the temperature in the high pressure flash towers. The pressure in towers 18 and 44 ranges from about 10 psig to 75 psig, more preferably 20 psig to 50 psig, and most preferably about 30 psig. The steam entering strippers 24 and 50 may be saturated or superheated at a pressure higher than the particular stripper tower pressure. Preferred conditions when using a propylene/acetone solvent are about 350° F and 140 psig. Decanter 82 operates at a temperature and pressure of from about 50° F to 120° F, and 80 psig to 215 psig, more preferably, 70° F to 110° F and 110 psig to 195 psig, and most preferably, 75° F and 120 psig when the solvent is propylene/acetone. At these conditions the water content of the liquid autorefrigerant phase varies from about 0.035 wt.% to about 0.93 wt.% over the temperature range of from 50° F to 120° F. At the most preferable temperature of 75° F, the water content is about 0.5 wt.%. The steam entering deketonizer 64 is saturated or superheated steam at a pressure higher than the deketonizer tower pressure, and generally about 140 psig and 350° F when the ketone is acetone.

PREFERRED EMBODIMENT

This invention will be more apparent from the preferred embodiment which is illustrated by the following example.

Referring to the drawing, in a dewaxing operation employing a solent comprising an 80/20 LV% mixture of propylene/acetone, 1750 lbs/hr of combined overheads from the dewaxed oil and wax strippers were fed to deketonizer 64 via lines 60, 62 and 100, approximately 80 lbs/hr of propylene from the stripper overheads being removed from expansion drum 92 via line 94. At the same time, 22,875 lbs/hr of deketonizer overhead were being fed to the decanter via lines 68, 72 and 76, none of said overhead being refluxed back into the deketonizer. The compositions and conditions of the various streams were as follows:

| | Composition, Wt. % | | | | |
|---|---|---|---|---|---|
| | Combined DWO and Wax Overhead | Wax H.P. Flash Overheads | Dry Propylene from Decanter | Deketonizer Overhead | Decanter/ Deketonizer Recycle |
| Propylene | 4.6 | 78.7 | 77.0 | | |
| Acetone | 31.4 | 20.8 | 22.5 | 85.5 | 58.0 |
| Water | 64.0 | 0.5 | 0.5 | 14.5 | 42.0 |
| Temperature, ° F | 380–395 | 70 | 75 | 197 | 75 |
| Pressure, psig | 15 | 120 | 120 | 5 | 120 |

The combined streams being fed to the deketonizer via line 100 totaled 1953 lbs/hr.

By way of contrast, when the combined overheads from strippers 24 and 50 were fed directly to decanter 82 instead of to deketonizer 64, 3474 lbs/hr of aqueous recycle from the decanter to the deketonizer were required in order to maintain the same dry solvent recovery rate from the decanter.

Hence, it becomes immediately obvious that by feeding the combined stripper overheads to the deketonizer instead of to the decanter, it is possible to effect a substantial reduction of about 50% in the size of the deketonizer.

What is claimed is:

1. In a dewaxing process comprising contacting a waxy oil with a dewaxing solvent comprising a mixture of a ketone wax antisolvent and an autorefrigerant to produce a dewaxed oil and wax slurry containing said solvents, separating said wax from said oil and wherein at least a portion of said solvents are recovered from the wax and dewaxed oil by a method which introduces excess water into said recovered solvents, the improvement which comprises removing the excess water from the recovered solvents by passing at least a major portion thereof to directly to a deketonizing zone to produce substantially ketone-free water and wet ketone with at least a portion of said wet ketone being passed diretly to a decanting zone in which is maintained a liquid layer of said autorefrigerant containing said ketone and minor amounts of water and in which is also maintained a liquid layer of wet ketone and continuously recycling said wet ketone layer back to said deketonizing zone and continuously removing autorefrigerant from the decanting zone.

2. The process of claim 1 wherein said method which introduces excess water into the recovered solvents is steam stripping.

3. The process of claim 2 wherein the autorefrigerant is selected from the group consisting of normally gaseous $C_2$ to $C_4$ hydrocarbons and mixtures thereof.

4. The process of claim 3 wherein the ketone is selected from the group consisting of $C_3$ to $C_6$ carbon atom ketones and mixtures thereof.

5. The process of claim 4 wherein the solvent is a mixture of propylene and acetone.

6. The process of claim 5 wherein the water produced in the deketonizing zone contains less than about 50 wppm of acetone.

7. In a lube oil dewaxing process comprising contacting a waxy lube oil stock with a dewaxing solvent comprising a mixture of ketone and autorefrigerant solvents to produce a dewaxed oil and wax slurry containing said solvents, separating the dewaxed oil from the wax and wherein the solvents are simultaneously separated and recovered from both the dewaxed oil and wax through the use of high and low pressure flash evaporation followed by gas stripping, the improvement which comprises using steam as the stripping gas and preventing water buildup in the recovered solvent by passing wet solvent overheads from the steam strippers to directly to a deketonizer to produce wet ketone solvent and substantially ketone-free water with at least a portion of the wet ketone being passed to a decanter and simultaneously passing autorefrigerant overhead from the wax high pressure flash evaporator to the decanter wherein is maintained a liquid layer of autorefrigerant containing ketone and minor amounts of water and a liquid layer of wet ketone and continuously recycling said wet ketone layer from the decanter back to the deketonizer and continuously removing liquid autorefrigerant from the decanter.

8. The process of claim 7 wherein the auto-refrigerant is selected from the group consisting of normally gaseous $C_2$ to $C_4$ hydrocarbons and mixtures thereof.

9. The process of claim 8 wherein the ketone is selected from the group consisting of $C_3$ to $C_6$ carbon atom ketones and mixtures thereof.

10. The process of claim 9 wherein the solvent is a mixture of propylene and acetone.

11. The process of claim 10 wherein the substantially ketone-free water produced in the deketonizer contains less than about 50 wppm of acetone.

12. The process of claim 11 wherein the decanter operates at temperatures ranging from 50° F to 120° F and at pressures ranging from 80 psig to 215 psig.

* * * * *